United States Patent [19]

Beckerman et al.

[11] 4,193,363

[45] Mar. 18, 1980

[54] LINT MINIMIZATION IN SEWING MACHINE BOBBIN ALARM

[75] Inventors: Howard L. Beckerman, Red Bank; Allan M. Dob, Clifton, both of N.J.

[73] Assignee: The Singer Company, New York, N.Y.

[21] Appl. No.: 31,675

[22] Filed: Apr. 19, 1979

[51] Int. Cl.[2] ..... D05B 51/00

[52] U.S. Cl. ..... 112/278; 112/228

[58] Field of Search ..... 112/278, 273, 228, 192; 139/273 A

[56] References Cited

U.S. PATENT DOCUMENTS

| | | | |
|---|---|---|---|
| 3,082,968 | 3/1963 | Reichelt et al. | 112/278 X |
| 3,083,659 | 4/1963 | Kuhar | 112/228 |
| 3,599,586 | 8/1971 | Newman | 112/278 |
| 3,650,230 | 3/1972 | Nishikawa | 112/192 |

*Primary Examiner*—Peter P. Nerbun

*Attorney, Agent, or Firm*—Edward P. Schmidt; Robert E. Smith; Edward L. Bell

[57] ABSTRACT

A light detector is supported in a mask box which extends into the cavity accommodating the looptaker with an edge of the surface adjacent the looptaker and upstream to the air currents generated by the looptaker closer to the looptaker than an edge downstream in order to discourage lint build up on the adjacent surface. A light source is fashioned with a lens projecting into the cavity accommodating the looptaker similarly to discourage lint build up.

1 Claim, 3 Drawing Figures

LINT MINIMIZATION IN SEWING MACHINE BOBBIN ALARM

DESCRIPTION

BACKGROUND OF THE INVENTION

This disclosure relates to sewing machines in general and more particularly to sewing machines which utilize a light source and a light sensor as part of a device to advise an operator of the impending depletion of bobbin thread.

It is known in the prior art to have systems for detecting bobbin thread depletion which make use of a light source and a light sensor. Such a system is disclosed in U.S. patent application Ser. No. 916,614, filed on June 19, 1978, which discloses an adjustable bobbin thread runout indicator.

It is also known in the field of sewing machines that the bobbin-looptaker area of the sewing machines is subject to lint build up since it is in this area that the work material and threads are concentrated. Considerable ingenuity has been exercised in solving the problem of lint build up in this particular area of sewing machines. An example of one such accommodation for this purpose is found in the U.S. Pat. No. 3,083,659, issued on Apr. 2, 1963 to Kuhar. That patent teaches the use of air currents to be generated by a specially constructed rotating hook in a deliberate effort to prevent the accummulation of lint in that area. The U.S. Pat. Nos. 3,650,230 and 3,374,757 of Nishikawa and Hamlett are further examples of appliances developed to remove dust or lint from the shuttle race area of the sewing machines.

While the lint in the prior art patent created a problem in loop formation and the dust in the shuttle race created friction and binding problem, it is known to those skilled in the art that the lint and the dust may also cause a problem with the bobbin thread alarm utilizing light detectors in that the lint or the dust may mask an empty condition of the bobbin by interfering with light transmission. What is required is a self cleaning arrangement for a low bobbin thread detection system using a light sensor, in order to decrease or eliminate a sensitivity to lint accumulation.

SUMMARY OF THE INVENTION

The above requirement is achieved in a design adjacent the area of the rotary looptaker which eliminates in so far as possible the build up of lint in the specific area of the light detector. The light detector is supported in a box extending adjacent the looptaker and protruding slightly into the cavity accommodating the looptaker. The rotation of the looptaker creates air currents which will move lint and cause it to be deposited on surfaces or cavities opening into the cavity accommodating the looptaker. The box supporting the light detector is fashioned to have a leading edge thereof protrude into the cavity accommodating the looptaker, and to have that surface facing the looptaker tapering away from the looptaker. An orifice in the face of this box, which provides passage for light from a source to the detector, is thus shielded from lint accumulation by the air currents generated by the looptaker.

Similarly, the light source may be implemented by a light bulb in a shielded opening behind a lens which extends into the cavity accommodating the looptaker so as to provide a minimum surface for accumulation of lint while utilizing the air currents generated by the looptaker in order to remove lint from the immediate area of the tip of the lens. Thus, the extension of the box supporting the light detector provides that there is no void to fill in front of the box; and by providing a protruding leading edge before the light passage orifice, lint may gather on the edge and leave the orifice clear. By utilizing a light lens in combination with the light source, the minimum surface is provided which protrudes into the air stream thus discouraging lint accumulation.

The aforementioned effects of the invention are attainable by the attachment and function of the parts constituting the invention, and the particulars thereof will be described in terms of a preferred embodiment with reference to the annexed drawings in which.

Figure 1:
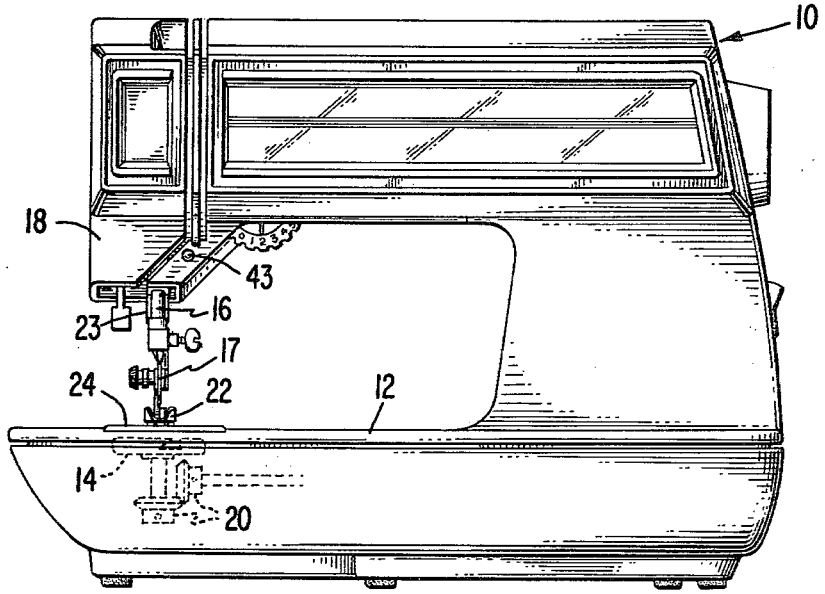
FIG. 1 is an elevation of the sewing machine in which the invention may be incorporated showing in dotted lines therein the looptaker area of concern.
Figure 2:
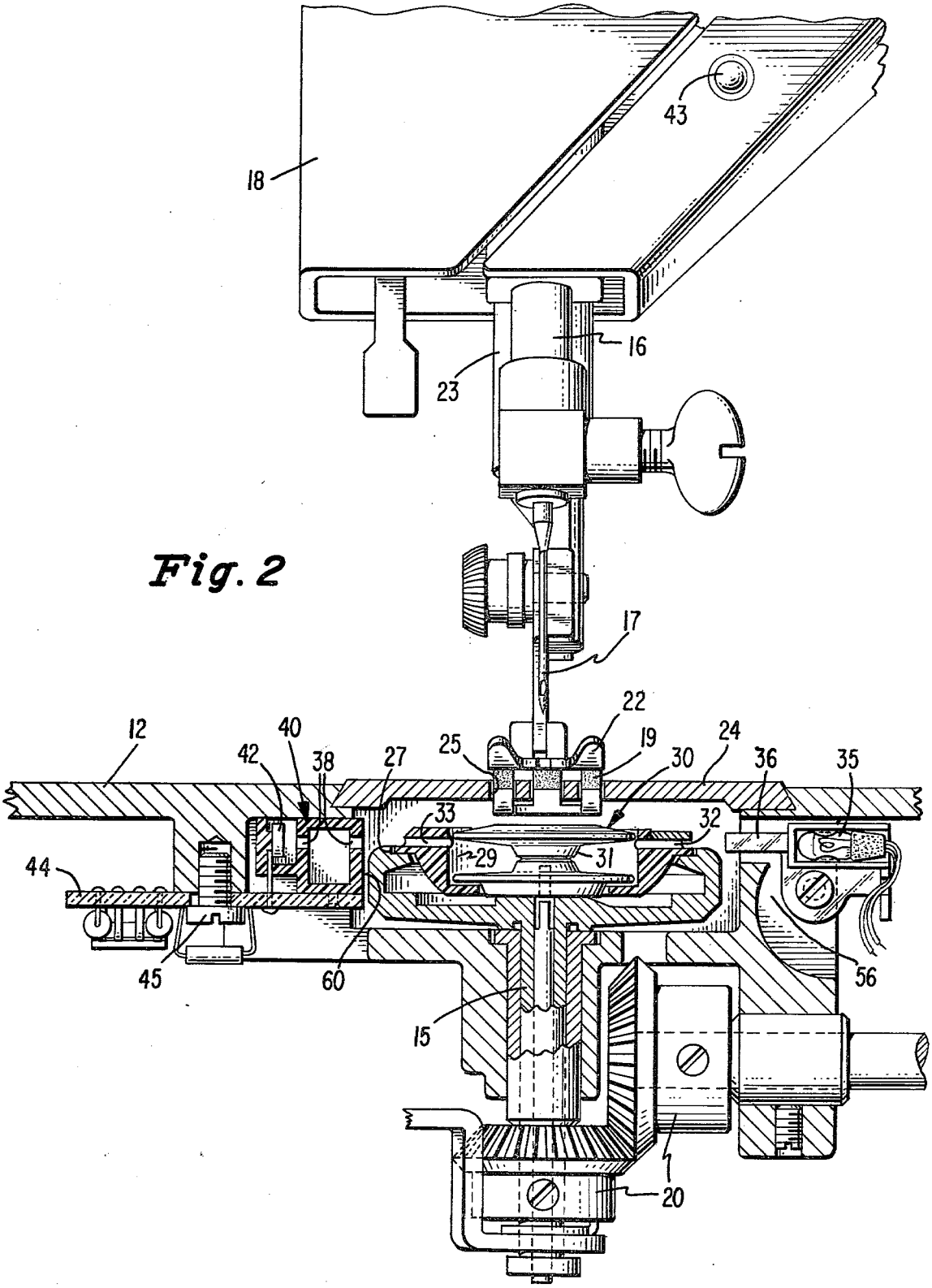
FIG. 2 is an enlarged view of a portion of the head end and looptaker shown partially in section in order to show more detail thereof; and, FIG. 3 is a plan view of the looptaker and bobbin area of the sewing machine indicating the placement of a light detector and box therefor and light source.

Referring now to FIG. 1, there is shown a sewing machine 10 including a bed portion 12 within which is supported a looptaker 14 for cooperation with an endwise reciprocating needle carrying needle bar 16 supported in the head end 18 of the sewing machine directly over the looptaker. The lower left above portion of the sewing machine 10 shown in FIG. 1 is shwon enlarged and partially in section in FIG. 2 to disclose more detail thereof. Thus, FIG. 2 shows a portion of the sewing machine 10 with the bed portion 12 and the sewing head 18 overhanging the bed. The bed portion 12 is formed with a cavity 13 in which the looptaker 14 is rotatably carried on one extremity of a vertical axis shaft 15. The shaft 15 is driven by miter gears 20 which are driven in the usual manner by the main sewing machine drive motor (not shown). The looptaker 14 rotates in timed syncronization to the reciprocation of the needle bar 16, the needle 17 carried by the needle bar being driven in endwise reciprocation through a work material supported on the sewing machine bed 12 for cooperation with the looptaker 14 carried therein in the formation of stitches. A feed dog 19 is visible which is a portion of a feeding system (not shown) for feeding work material under the sewing needle 17 in order to generate a line of stitches. The work material is pressed against the feed dog 19 by presser foot 22 supported on the end of a presser bar 23 which is urged downwardly in a manner well known in the sewing machine art. A throat plate 24 supports the work material and is fashioned with an orifice (not shown) through which the sewing needle 17 may project and slots 25 through which the feed dog 19 may extend.

The looptaker 14 supports on a race 27 thereof a bobbin case 28. The bobbin case 28 is restrained from the rotary motion with the looptaker 14 by a position plate 52 (see FIG. 3). The bobbin case 28 is fashioned with a cavity 29 within which is supported a bobbin 30 for the carrying of lower thread for a lockstitch. A further explanation of the looptaker, bobbin case and bobbin arrangement and how thread may be wound thereupon may be had by reference to the U.S. Pat. No. 3,693,566, issued on Sept. 26, 1972, to Ketterer, which patent is assigned to the same assignee as the instant invention, and which is hereby incorporated by reference herein. The teachings of the above referenced patent have been modified somewhat by extending the bobbin case 28 above the level of the looptaker 14 in order that bores 32, 33 might extend therethrough roughly tangent the hub 31 of the bobbin 30 (see FIG. 3). The purpose of the bores 32, 33 is to allow the passage of light from a light source 35 as focused by a lens 36. The light rays extending from the bore 33 pass through orifices 38 in a mask box 40, which box supports a light detector 42 on an inner wall thereof aligned with the orifices. Where the bobbin 30 carries a sufficient amount of thread on the hub 31 thereof to block passage of light to the bore 33, there will be no indication of a low thread condition. If however, the hub 31 carries insufficient thread to prevent the passage of light rays to and through the bore 33, the light will picked up by the light detector 42 and by means of suitable circuitry on printed circuit board 44 a low bobbin indication may be given such as flashing a visual alarm 43 in the head end 18. The printed circuit board 44 is affixed to the bed portion 12 by screw 45 and the mask box 40 is supported on the printed circuit board with the light detector 42 having electrical connection thereto.

Figure 3:
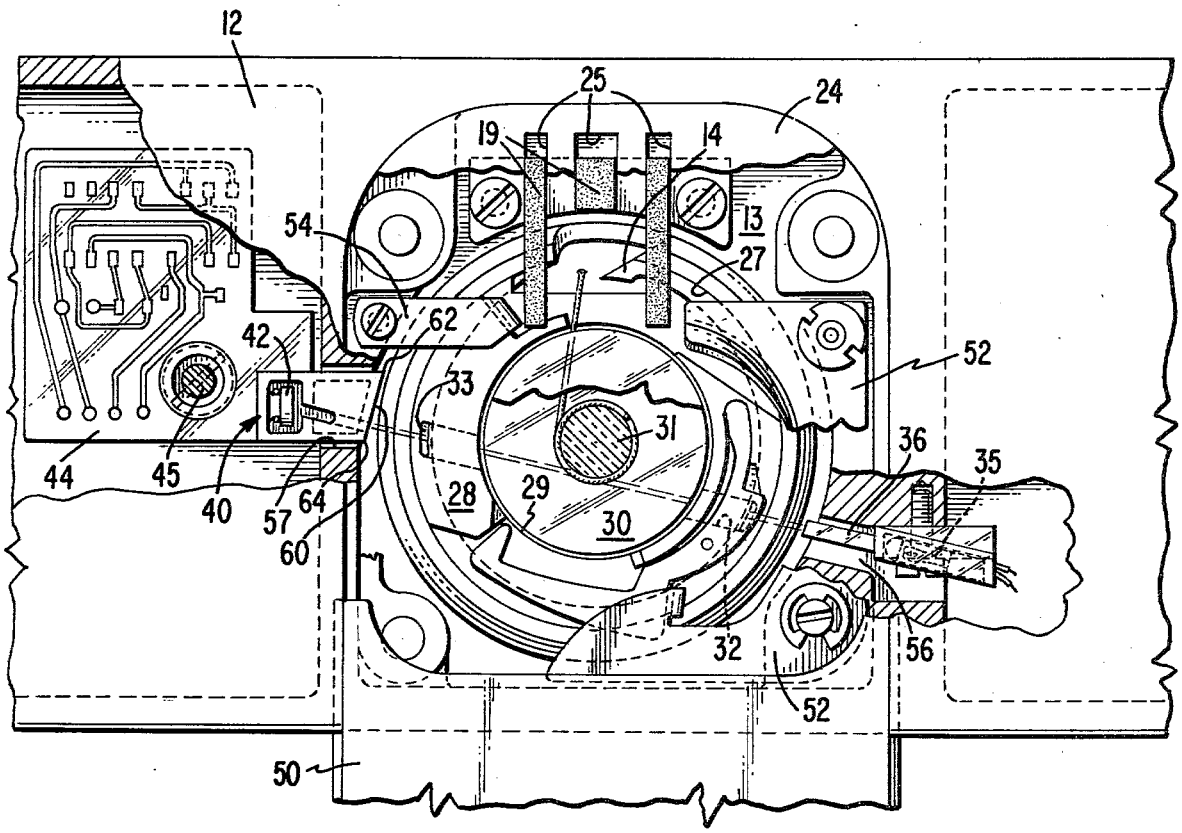

Referring now to FIG. 3, there is shown a plan view of the left side of the bed portion 12 showing the cavity 13 therein with the throat plate 24 removed and with a bed slide 50 thereof slid back to expose the looptaker 14, bobbin case 28 and bobbin 30. There is also visible a portion of the position plate 52 and a position finger 54 which serve to retain the bobbin case 28 in a stationary position against rotation with the looptaker 14 while permitting thread to be cast thereabout. There is shown the light source 35 and lens 36, which lens may provide the resolution to determine the presence of a single layer of thread upon the hub of the bobbin.

There is also evident the outline of the bed cavity 13 in which the looptaker 14 is situated, and the cavities 56, 57 opening up into the cavity 13 for receiving respectively the light source 35 and lens 36 and, mask box 40. It is apparent from an inspection of FIGS. 2 and 3 that the lens 36 projects from the cavity 56 into the cavity 13 and therefore into the air stream created by rotation of the looptaker 14. Thus, lint cannot build up in front of the lens 36 and, by its position in the air stream, lint removal from the front of the lens is facilitated.

In the plan view of FIG. 3, it is evident from the outline of the mask box 40 on the opposite side of the looptaker 14 from the light source 35 that the front surface 60 of the box projects into the cavity 13 and thereby into the air stream produced by the looptaker 14 during its rotation, with the leading edge 62 of the surface extending closer to the looptaker than the trailing edge 64. In this fashion, any lint build up which might occur, will occur on the leading edge 62 some distance away from the orifice 38, and the air currents generated by the looptaker 14 will take any lint extending over the leading edge of the surface 60 and carry it away therefrom.

We claim:

1. A sewing machine having a frame including a bed portion, said bed portion having a cavity for receiving a looptaker, a looptaker rotatably supported in said cavity, a bobbin case supported in said looptaker against rotation therewith, said bobbin case freely supporting a lower thread carrying bobbin therein, means for sensing the thread carrying condition of said bobbin, said sensing means including a light source and a light detector, wherein the improvement comprises:

means for enclosing said light source and extending a lens portion thereof into said looptaker cavity; and means for encasing said light detector with a portion thereof extending into said cavity, said portion being formed on a surface adjacent said looptaker with an edge of said surface facing upstream relative to the windage generated by said looptaker and extending close to said looptaker and with said adjacent surface tapering away from said looptaker to a trailing edge facing downstream relative to said upstream edge, said adjacent surface being formed with an orifice for passage of rays from said light source to said light detector.

* * * * *